US007325872B2

(12) United States Patent
Basu et al.

(10) Patent No.: US 7,325,872 B2
(45) Date of Patent: Feb. 5, 2008

(54) ROCKER AND METHOD OF USING THE SAME

(75) Inventors: Scott K. Basu, East Aurora, NY (US); Christopher J. Hayes, West Falls, NY (US); Matthew C. Maxwell, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 621 days.

(21) Appl. No.: 10/270,474

(22) Filed: Oct. 15, 2002

(65) Prior Publication Data

US 2004/0082396 A1 Apr. 29, 2004

(51) Int. Cl.
*A47C 3/02* (2006.01)
*A47C 7/62* (2006.01)

(52) U.S. Cl. ..... 297/271.5; 297/217.4

(58) Field of Classification Search ..... 297/271.5, 297/258.1, 217.4, 217.6, 217.3, 259.1, 217.7, 297/260.1, 260.2, 271.1, 170, 156, 138, 142, 297/143, 452.41, 181, 131–133, 195.11; 5/105–108, 101–103; D6/344–346, 352, D6/385, 348; 472/95–102, 135, 114
See application file for complete search history.

(56) References Cited

U.S. PATENT DOCUMENTS

| | | | | |
|---|---|---|---|---|
| 60,684 | A * | 1/1867 | Burr | 5/106 |
| 682,297 | A * | 9/1901 | Tucker | 297/142 |
| 691,931 | A | 1/1902 | Bryan | |
| 2,452,838 | A * | 11/1948 | Come | 5/3 |
| 2,501,861 | A * | 3/1950 | Braun | 84/95.2 |
| D169,437 | S | 4/1953 | Grotrian-Steinweg | |
| 3,676,276 | A * | 7/1972 | Hirshen et al. | 428/12 |
| 3,698,125 | A | 10/1972 | Hartling et al. | |
| 3,762,766 | A * | 10/1973 | Barecki et al. | 297/217.1 |
| 3,899,797 | A * | 8/1975 | Gunst | 5/655.3 |
| 4,023,458 | A | 5/1977 | DeCesare | |
| 4,827,826 | A | 5/1989 | Isashi | |
| 5,016,301 | A * | 5/1991 | Combs | 5/105 |
| 5,145,447 | A | 9/1992 | Goldfarb | |
| D339,001 | S | 9/1993 | Schiffman | |
| 5,248,843 | A | 9/1993 | Billings | |
| 5,292,296 | A * | 3/1994 | Davignon | 482/146 |
| 5,382,188 | A | 1/1995 | Tomellini | |
| 5,490,711 | A | 2/1996 | Pollock | |
| 5,545,071 | A | 8/1996 | Shiraishi | |
| 5,588,164 | A | 12/1996 | Proulx | |
| 5,773,738 | A | 6/1998 | Chou | |
| 6,000,750 | A | 12/1999 | Rossman et al. | |
| 6,024,409 | A | 2/2000 | Collins | |

(Continued)

FOREIGN PATENT DOCUMENTS

JP 2000-153078 A 6/2000

*Primary Examiner*—Milton Nelson, Jr.
(74) *Attorney, Agent, or Firm*—Cooley Godward Kronish LLP

(57) ABSTRACT

A rocker that may be used to entertain an infant. In one embodiment, the rocker includes a seat portion, an activity portion and a connector. The connector is coupled to the seat portion and to the activity portion. In one embodiment, the seat portion and the activity portion are configured to rock on a support surface. In one embodiment, the seat portion and the activity portion can be rocked side-to-side. The rocker includes an output generating system that can generate audible and/or visual outputs.

31 Claims, 7 Drawing Sheets

U.S. PATENT DOCUMENTS 6,089,663 A * 7/2000 Hill ..... 297/258.1
6,132,281 A 10/2000 Klitsner et al.
6,142,849 A 11/2000 Horton et al.
6,378,940 B1 * 4/2002 Longoria et al. ..... 297/217.3
6,412,867 B2 * 7/2002 Robinson ..... 297/260.2
6,416,381 B1 7/2002 Walter et al.

* cited by examiner

ROCKER AND METHOD OF USING THE SAME

BACKGROUND OF THE INVENTION

This invention relates generally to a rocker, and in particular, to a rocker that produces audible and/or visual outputs.

Some conventional rocking devices include an output system that generates music. Other conventional rocking devices include activity centers that provide entertainment for an infant. Many conventional rocking devices do not provide for physical play by an infant and an output generating system that can be activated by an infant. Accordingly, infants quickly become disinterested in conventional rocking devices.

A need exists for a rocker that is easy to move and that generates outputs to stimulate a user. A need also exists for a rocker that provides for physical interaction with a user.

SUMMARY OF THE INVENTION

The present invention relates to a rocker that may be used to entertain an infant. In one embodiment, the rocker includes a seat portion, an activity portion and a connector. The connector is coupled to the seat portion and to the activity portion. In one embodiment, the seat portion and the activity portion are configured to rock on a support surface. In one embodiment, the seat portion and the activity portion can be rocked side-to-side.

The rocker includes an output generating system that can be activated by an infant. In one embodiment, the output generating system is connected to several input mechanisms that can be activated by an infant. In one embodiment, the rocker includes a motion sensing switch, which can be activated by the movement of the rocker. In another embodiment, the rocker includes several simulated piano keys that can be pressed and activated by an infant.

In one embodiment, the output generating system also includes several output mechanisms that generate various outputs in response to inputs. In one embodiment, the rocker includes several illumination devices or light sources that can be illuminated in response to an input. In another embodiment, the output generating system includes a sound generating system that generates audio outputs such as music and/or sound effects.

DETAILED DESCRIPTION OF THE INVENTION

The present invention relates to a rocker that may be used to entertain an infant. In one embodiment, the rocker includes a seat portion, an activity portion and a connector. The connector is coupled to the seat portion and to the activity portion. In one embodiment, the seat portion and the activity portion are configured to rock on a support surface. In one embodiment, the seat portion and the activity portion can be rocked side-to-side.

The rocker includes an output generating system that can be activated by an infant. In one embodiment, the output generating system is connected to several input mechanisms that can be activated by an infant. In one embodiment, the rocker includes a motion sensing switch, which can be activated by the movement of the rocker. In another embodiment, the rocker includes several simulated piano keys that can be pressed and activated by an infant.

In one embodiment, the output generating system also includes several output mechanisms that generate various outputs in response to inputs. In one embodiment, the rocker includes several illumination devices or light sources that can be illuminated in response to an input. In another embodiment, the output generating system includes a sound generating system that generates audio outputs such as music and/or sound effects.

Figure 1:
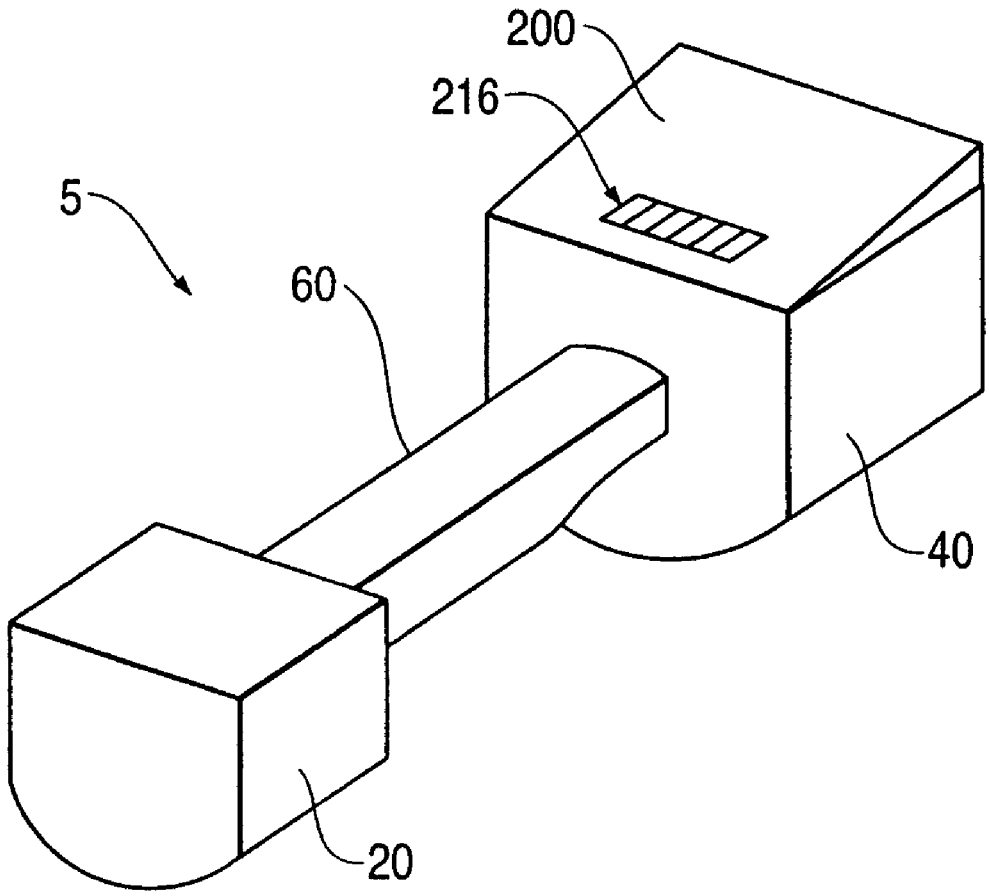
FIG. 1 illustrates a perspective view of an embodiment of a rocker according to the present invention.

A schematic view of an embodiment of a rocker according to the present invention is illustrated in FIG. 1. In the illustrated embodiment, the rocker 5 includes a seat portion 20, an activity portion 40, and a connector 60. In this embodiment, the seat portion 20 and the activity portion 40 are coupled to opposite ends of the connector 60.

In the illustrated embodiment, the rocker 5 includes an entertainment device 200. The entertainment device 200 includes several actuators 216 that can be activated by a user. An infant can sit on the seat portion 20 or the connector 60 and activate the entertainment device 200 by pressing actuators 216. In the illustrated embodiment, the entertainment device 200 is fixedly coupled to the activity portion 40. In an alternative embodiment, the entertainment device 200 can be releasably coupled to the activity portion 40.

Figure 2:
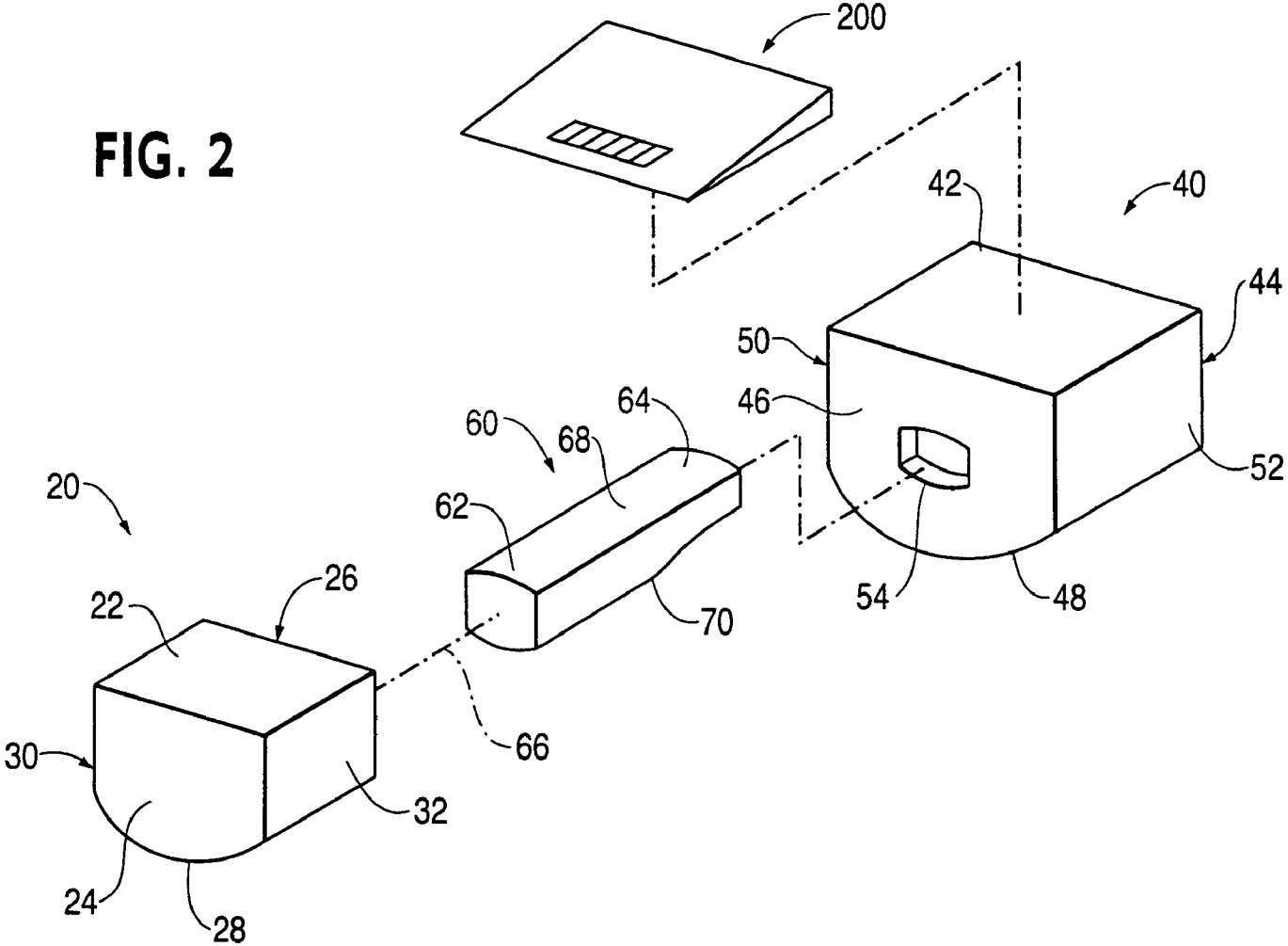
FIG. 2 illustrates an exploded perspective view of the rocker of FIG. 1.

An exploded perspective view of the rocker of FIG. 1 is illustrated in FIG. 2. In this embodiment, the seat portion 20 and the activity portion 40 are each removably coupled to the connector 60. While the entertainment device 200 is illustrated as separated from the activity portion 40, in alternative embodiments, the entertainment device 200 can be integrally formed with or fixedly coupled to the activity portion 40.

Figure 3:
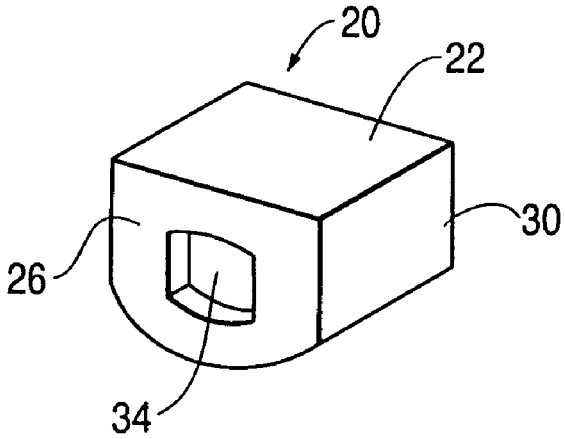
FIG. 3 illustrates a front perspective view of a seat portion of the rocker of FIG. 1.

In the illustrated embodiment, the seat portion 20 includes an upper or support surface 22, a rear surface 24, a front surface 26, and side surfaces 30 and 32. As illustrated in FIG. 3, in one embodiment, the front surface 26 of the seat portion 20 includes an opening 34 formed therein, the function of which is described in detail later.

Returning to FIG. 2, the seat portion 20 also includes a base or lower surface 28 that engages a support surface on which the seat portion 20 is placed. As illustrated, the base surface 28 is curved to facilitate the rocking of the seat portion 20 on the support surface.

In the illustrated embodiment, the upper surface 22 of the seat portion 20 is substantially coextensive with the base surface 28 of the seat portion 20 in that the upper surface 22 covers approximately the same amount of area as the base surface 28. In alternative embodiments, the upper surface 22 may extend beyond the perimeter or profile of the base surface 28 or it may be smaller than the base surface 28.

The activity portion or component 40 includes an activity or upper surface 42, a front surface 44, a rear surface 46, and side surfaces 50 and 52. The rear surface 46 includes an opening 54 into which a portion of connector 60 can be inserted.

The activity portion 40 also includes a base or lower surface 48 that engages a support surface on which the activity portion 40 is placed. As illustrated, the base surface 48 is curved to facilitate the rocking of the activity portion 40 on a support surface. The curvature of base surface 28 and the curvature of the base surface 48 are substantially the same.

In the illustrated embodiment, the upper surface 42 of the activity portion 40 is substantially coextensive with the lower surface 48 of the activity portion 40 in that the upper surface 42 covers approximately the same amount of area as the lower surface 48. In alternative embodiments, the upper surface 42 may extend beyond the perimeter or profile of the lower surface 48 or it may be smaller than the base surface 48.

The connector or neck portion 60 includes a first end 62, a second end 64, and a longitudinal axis 66. As illustrated, the longitudinal axis 66 of the connector 60 extends substantially horizontally between the first end 62 and the second end 64 of the connector 60.

In one embodiment, the second end 64 of the connector 60 can be inserted into opening 54 on the activity portion 40. Similarly, the first end 62 of the connector 60 may be inserted into opening 34 on the seat portion 20. The connector ends 62 and 64 may be coupled to the seat portion 20 and the activity portion 40 via conventional connectors or fasteners, such as screws, rivets, bolts, etc. Alternatively, the ends 62 and 64 may be frictionally retained in the seat portion 20 and the activity portion 40, respectively.

Figure 4:
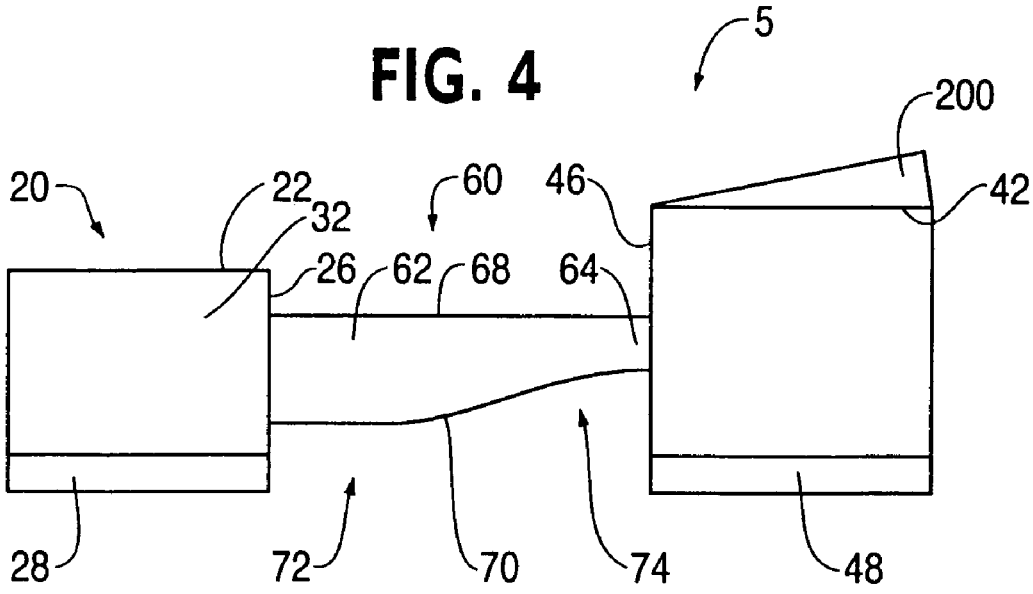
FIG. 4 illustrates a side view of the rocker of FIG. 1.

A side view of the rocker of FIG. 1 is illustrated in FIG. 4. As illustrated, the connector 60 extends between the seat portion 20 and the activity portion 40. The lower surface 28 of the seat portion 20 and the lower surface 48 of the seat portion 40 are spaced apart and separate from each other.

Figure 5:
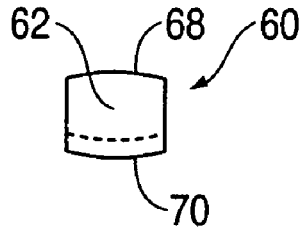
FIG. 5 illustrates an end view of a connector of the rocker of FIG. 1.

The connector 60 includes a top surface 68 and a lower surface 70. As illustrated, the lower surface 70 has a non-linear configuration. In particular, the top surface 68 and the lower surface 70 each has a curved configuration (see FIG. 5). A user may sit on the top surface 66 of the connector 60. In alternative embodiments, the top surface 66 may have any particular configuration.

In the illustrated embodiment, the lower surface 70 of the connector 60 includes a first portion 72 and a second portion 74. The height of the connector 60 at its first portion 72 is greater than the height of the connector 60 at its second portion 74.

As illustrated in FIG. 4, the lower surface 70 at first portion 72 is configured to engage a support surface on which the rocker 5 is placed. Moreover, portion 72 of the lower surface 70 is substantially aligned with the lower surface 28 of seat portion 20. Portion 72 is curved and has a radius of curvature substantially similar to that of base portion 28 of seat portion 20. In the illustrated embodiment, the second portion 74 of the lower surface 70 is vertically offset from the lower surface 48 of the activity portion 40.

In an alternative embodiment, the entire lower surface 70 of connector 60 is substantially aligned with the lower surface 28 of seat portion 20 and the lower surface 48 of the activity portion 40. In such an embodiment, the lower surface 70 engages the support surface along the length of the exposed portion of the connector 60.

In another embodiment, the entire lower surface of the connector can be vertically offset from the lower surfaces of the seat portion and the activity portion. In this embodiment, the lower surface of the connector does not engage the support surface.

Figure 6:
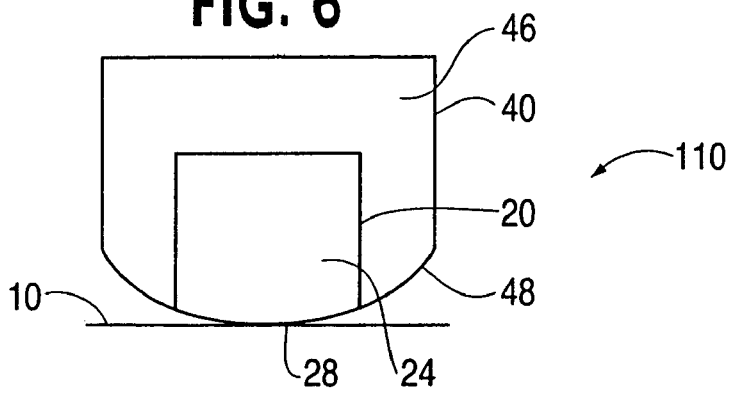
FIG. 6 illustrates an end view of the rocker of FIG. 1 in a first orientation.
Figure 7:
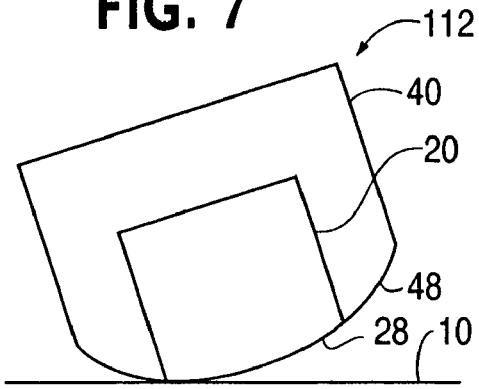
FIG. 7 illustrates an end view of the rocker of FIG. 1 in a second orientation.
Figure 8:
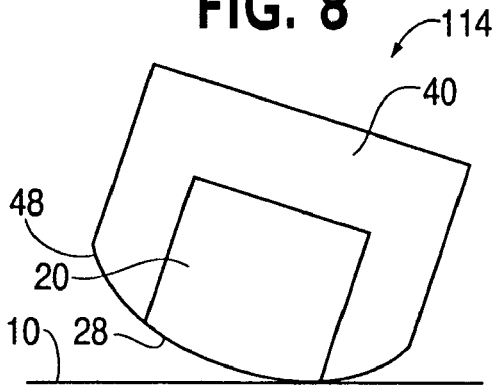
FIG. 8 illustrates an end view of the rocker of FIG. 1 in a third orientation.

The rocker 5 can be moved into multiple orientations with respect to a support surface as illustrated in FIGS. 6-8. In the illustrated embodiment, the rocker 5 can be rocked side-to-side along support surface 10 due to the curved lower surfaces 28 and 48 of seat portion 20 and activity portion 40, respectively. The lower surfaces 28 and 48 of the rocker 5 are configured to move back and forth or side-to-side along a direction substantially perpendicular to the longitudinal axis 66 of the connector 60.

The rocker 5 can be disposed in a first orientation 110 with respect to a support surface 10 (see FIG. 6). A user can move the rocker 5 into a second orientation 112 (see FIG. 7) and into a third orientation 114 (see FIG. 8). The portions of the seat portion 20 and the activity portion 40 that are in contact with the support surface 10 in one of the orientations are not in contact with the support surface 10 in other orientations of the rocker 5. As illustrated, the central portions of the lower surfaces 28 and 48 are in contact with the support surface 10 in the neutral or first orientation 110. The opposite side portions of the lower surfaces 28 and 48 are in contact with the support surface 10 in orientations 112 and 114, respectively. The opposite side portions may be referred to as left and right side portions based on the orientation of the rocker 5 in FIGS. 6-8.

Figure 9:
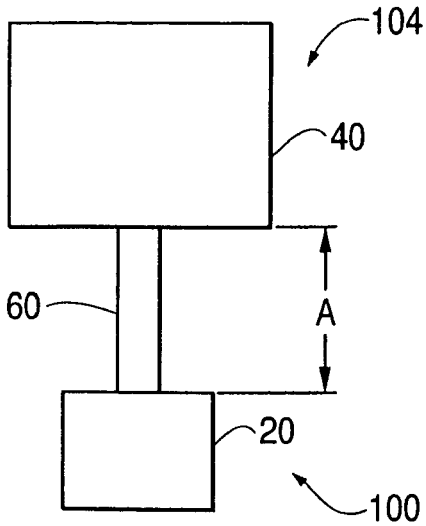
FIG. 9 illustrates a top view of the rocker of FIG. 1 in a first configuration.
Figure 10:
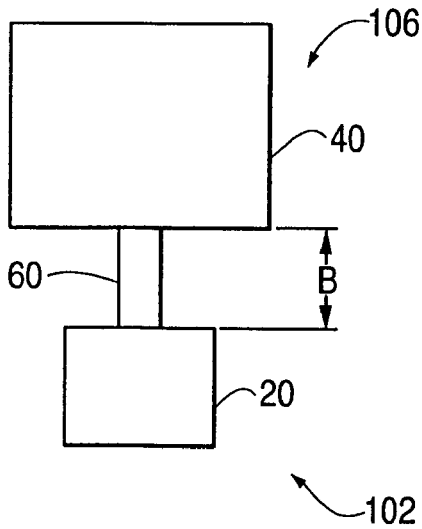
FIG. 10 illustrates a top view of the rocker of FIG. 1 in a second configuration.

The rocker 5 can be disposed in multiple configurations as illustrated in FIGS. 9 and 10. The rocker 5 includes components that can be moved relative to each other to form the configurations. In the illustrated embodiment, the seat portion 20 can be moved relative to the activity portion 40.

The rocker 5 is illustrated in a first configuration 104 in FIG. 9. In this configuration, the seat portion 20 is disposed in a first position 100 that is spaced a distance A from the activity portion 40. The rocker 5 is illustrated in a second configuration 106 in FIG. 10. In this configuration, the seat portion 20 is disposed in a second position 102 that is spaced a distance B from the activity portion 40. The distances A and B vary depending on the desired position of the seat portion 20 relative to the activity portion 40.

The seat portion 20 can be coupled to the connector 60 in multiple positions. While two different seat portion positions are illustrated, in alternative embodiments, the seat portion 20 can be configured to be disposed in any number of positions along connector 60.

Figure 11:
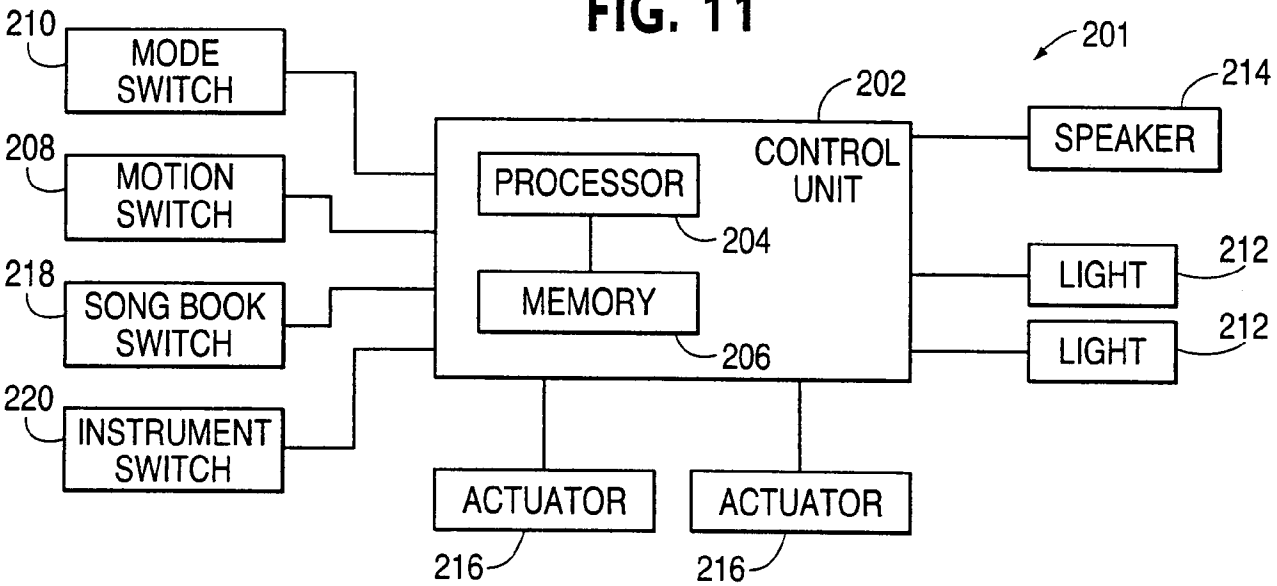
FIG. 11 illustrates a schematic view of an embodiment of an output generating system according to the present invention.

An embodiment of an output generating system of the present invention is illustrated in FIG. 11. In the illustrated embodiment, the output generating system 201 includes several input mechanisms and several output mechanisms. The input mechanisms can be activated to cause the output generating system 201 to generate one or more outputs. The output mechanisms are used to entertain a user of the rocker.

The output generating system 201 includes a control unit 202 with a processor 204 and memory 206. An exemplary processor that can be used is a Sonix model SN66060. The memory 206 includes pre-recorded output programs, such as light sequences, and audio outputs, such as music and sound effects.

In the illustrated embodiment, the output generating system 201 includes several input mechanisms. Some exemplary input mechanisms include a motion sensing or motion-activated switch 208, a mode switch 210, a song book switch 218 and an instrument selector switch 220. The rocker 5 may also include several actuators 216 that can be activated by a user.

The motion switch 208 enables a user to activate the output generating system 201 by rocking the rocker 5 side-to-side. The motion switch 208 can be any conventional motion-activated switch that can be alternatively opened and closed based on the movement of the rocker 5.

Figure 12:
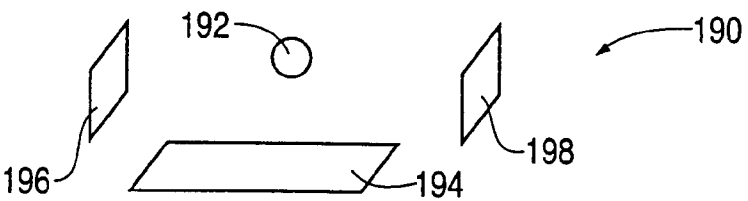
FIG. 12 illustrates an exploded perspective view of an embodiment of a motion sensing switch according to the present invention.

An embodiment of a motion switch according to the present invention is illustrated in FIG. 12. In this embodiment, motion switch 190 includes a ball 192 that is mounted in a cavity (not shown) in the entertainment device 200. The motion switch 190 includes a conductive bottom plate 194 and two conductive side plates 196 and 198. As the ball 192 rolls back and forth in the cavity, the ball 192 remains in constant contact with the bottom plate 194. When the rocker 5 is tipped to either side, the ball 192 contacts the corresponding side plate 196 or 198 and a corresponding signal is generated by the switch 190 and sent to the processor 204. The generated signal indicates whether the left side switch (side plate 196 and common plate 194) is closed or whether the right side switch (side plate 198 and common plate 194) is closed. The outputs generated by the output generating system 201 will vary depending on the particular signal received by the processor 204.

Returning to FIG. 11, the song book switch 218 enables a user to select between multiple songs stored in the memory 206 of the control unit 202. The song book switch 218 includes a movable member and a conventional momentary switch that is closed when it is engaged by the movable member. The particular song that is played depends on the position of the movable member of the switch 218.

The instrument selector switch 220 enables a user to select musical outputs resembling different musical instruments. The instrument selector switch 220 may include a movable member, such as a rotatable knob, that can be disposed in multiple positions, each of which corresponds to a musical instrument. A switch may be engaged by the knob to allow a user to select music associated with a particular instrument. In one embodiment, the knob includes a grain-of-wheat (GOW) bulb that moves with the knob.

The output generating system 201 includes actuators 216 that can be activated or pressed by an infant. In the illustrated embodiment, the actuators 216 resemble piano keys and form a keyboard. Each actuator 216 is pivotally mounted to a portion of the entertainment device 200 and engages a corresponding switch when the actuator 216 is pressed. In one embodiment, each switch is a push button switch.

The mode switch 210 enables a user to select between multiple modes of operation of the output generating system 201. In one embodiment, the output generating system 201 includes three different modes of operations. For example, the output generating system 201 includes a rock-and-play mode in which music such as a song is played while the rocker 5 is rocked. The output generating system 201 also includes a song building mode in which consecutive portions of a song is played each time the rocker is rocked side-to-side. The output generating system 201 also includes a free play mode in which a user can press actuators on the output generating system 201 to activate the output generating system. The particular outputs generated depend on the mode of operation of the output generating system 201.

The output generating system 201 includes several output mechanisms. The output mechanisms are controlled by the control unit 202 based on particular inputs received by the output generating system 201.

One output mechanism is a speaker 214 through which audio outputs can be played. Another output mechanism is a light source. In one embodiment, the output generating system 201 includes several light sources, such as light bulbs, GOW bulbs, or LEDs. In one embodiment, each light source 212 is associated with and is disposed below one of the actuators 216. A light source 212 can illuminate an actuator 216 that is made from a transparent or semi-transparent material. In an alternative embodiment, the entertainment device 200 may include light sources at locations other than the actuators 216.

Figure 13:
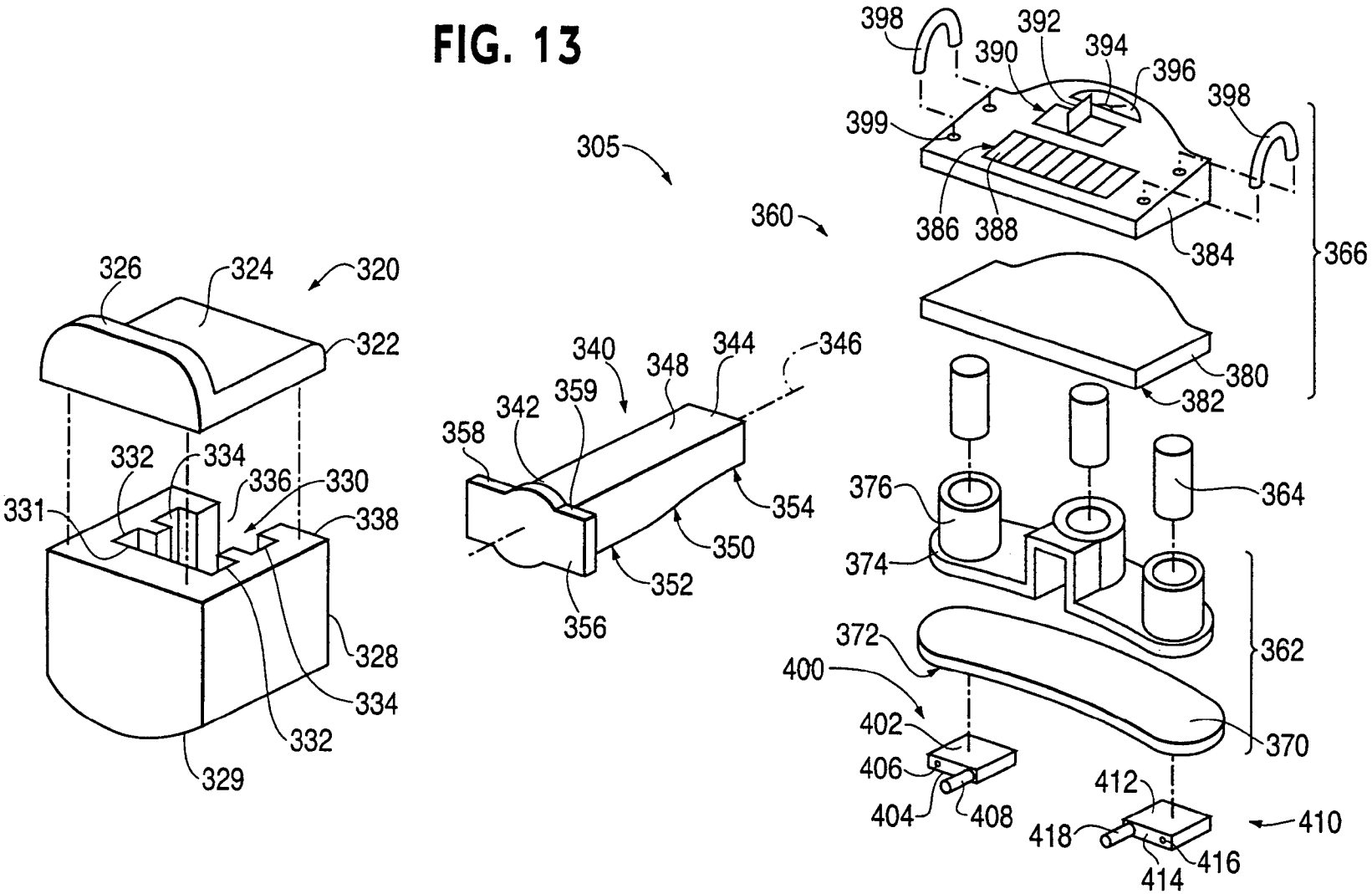
FIG. 13 illustrates an exploded perspective view of an alternative embodiment of a rocker according to the present invention.

An alternative embodiment of a rocker according to the present invention is illustrated in FIG. 13. In this embodiment, the rocker 305 includes a seat portion 320, a connector 340, and an activity portion 360. The connector 340 is coupled to the seat portion 320 and the activity portion 360.

In this embodiment, the seat portion 320 includes a seat top 322 and a seat bottom 328. The seat top 322 and the seat bottom 328 can be coupled together using any conventional fastener, such as a screw, rivet, bolt, etc. Alternatively, the seat top 322 and the seat bottom 328 may be integrally formed.

The seat top 322 includes an upper surface 324 on which an infant can sit. The upper surface 324 is configured to support an infant. The seat top 322 also includes a seat back 326 that can be engaged by an infant on the upper surface 324.

The seat bottom 328 includes a cavity 330 and an opening 336 formed in the front surface 338 of the seat bottom 328. The seat bottom 328 includes an inner wall 331 that defines the cavity 330. The inner wall 331 includes multiple sets of recesses 332 and 334 formed along the cavity 330. The function of the recesses 332 and 334 will be explained in detail later. The seat bottom 328 also includes a lower surface 329 on which the seat portion 320 can be placed onto a support surface.

In this embodiment, the connector 340 has a first end 342, a second end 344, and a longitudinal axis 346. The connector 340 includes an upper surface 348 and a lower surface 350. Similar to connector 60, the connector lower surface 350 has a first portion 352 and a second portion 354 that may be spaced a different distance from the support surface than the first portion 352.

Connector 340 includes a coupler 356 proximate to end 342 of the connector 340. The coupler 356 is integrally formed with the remainder of connector 340. The coupler 356 includes radially extending flanges 358 and 359. In an alternative embodiment, the coupler 356 can be formed separate from and coupled to the remainder of the connector 340.

In this embodiment, the connector 340 is inserted into the cavity 330 of the seat portion 320. In particular, the coupler 356 is disposed so that flanges 358 and 359 are aligned with either recesses 332 or recesses 334. When the coupler 356 has been selectively located, the seat top 322 is coupled to the seat bottom 328. In one embodiment, the seat top 322 and the seat bottom 328 can be coupled together using conventional fasteners. In another embodiment, the seat top 322 and the seat bottom 328 can be coupled together via snap-fit arrangement, such as tabs and recesses.

In alternative embodiments, the seat bottom 328 may include any number of recesses formed in cavity 330. The number of recesses can vary based on the desired number of positions for the seat portion 320 relative to the activity portion 360.

In the illustrated embodiment, the activity portion 360 includes a rocker base 362, several couplers 364, and an entertainment component 366. Each of the couplers 364 is coupled to the rocker base 362 and to the entertainment component 366. In alternative embodiments, the number of couplers 364 can vary.

In this embodiment, the rocker base 362 includes a rocker bottom 370 and a rocker top 374. The rocker bottom 370 and the rocker top 374 are coupled together using conventional fasteners. The rocker bottom 370 includes a curved lower surface 372 that is configured to engage a support surface. The lower surface 372 of the rocker bottom 370 has substantially the same curvature as the lower surface 329 of the seat portion 320.

The rocker top 374 includes several receptacles 376 that are configured to engage the couplers 364. In one embodiment, each coupler 364 includes one or more resilient tabs (not shown) that engage a corresponding recess on the receptacle 376.

In this embodiment, the entertainment component 366 includes a lower housing 380 and an upper housing 384. The lower housing 380 and the upper housing 384 can be coupled via conventional fasteners.

The lower housing 380 includes a lower surface 382 that is configured to be coupled to the couplers 364. For example, the lower surface 382 can include recesses, each of which is configured to receive a portion of a coupler 364, such as a resilient tab on a coupler 364.

The upper housing 384 has a play portion 386 that includes several actuators 388. In this embodiment, the actuators 388 resemble piano keys and form a keyboard. Beneath each actuator 388 is a momentary switch that is closed when a user presses downwardly on an actuator 388. When the switch is closed, a signal is sent to the processor 204 as previously described.

The upper housing 384 also includes a song selection portion 390. A movable member that resembles a page 392 is pivotally mounted to the upper housing 384 proximate to the song selection portion 390. The page 392 includes a protrusion or extension (not shown) that engages a song selection switch when the page is flipped past a vertical position. The switch can be used to determine which side of the page 392 is displayed. This information is used to identify one or more outputs, such as songs, that are associated with the particular displayed portion of the page or pages.

The upper housing 384 also includes an instrument selection switch 394. In this embodiment, a rotating member, such as a knob, 396 is coupled to the upper housing 384. The rotating member 396 engages a switch that can be used by a user to select the music associated with a particular instrument.

In this embodiment, the entertainment component 366 includes a pair of handles 398 that are coupled to the upper housing 384. A user can grasp the handles 398 and rock the rocker 305. In one embodiment, the ends of the handles 398 are snap fit into openings 399 on the upper housing 384.

In this embodiment, the rocker 305 includes stops 400 and 410 coupled to the rocker base 362. In one embodiment, the stops 400 and 410 are pivotally coupled to the lower surface 372 of the rocker bottom 370. Each of the stops 400 and 410 is independently movable between a retracted position in which the rocker 305 can freely rock and an extended position in which the rocker 305 is prevented from rocking.

Figure 16:
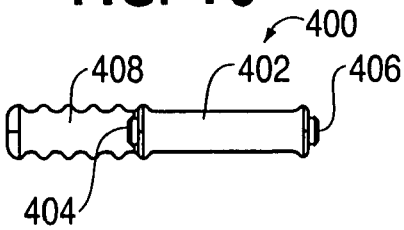
FIG. 16 illustrates an end view of a stop of the rocker of FIG. 13.
Figure 17:
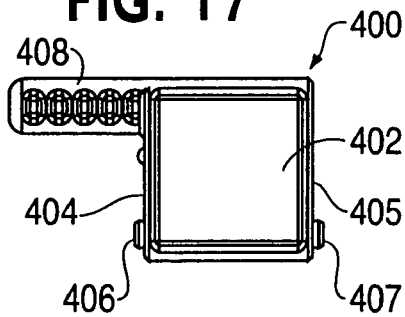
FIG. 17 illustrates a bottom view of the stop of FIG. 16.

As illustrated in FIG. 13, stop 400 includes a body 402 and an extension 408. The body 402 includes a first side 404 on which a mounting extension 406 is located. The opposite side 405 of the body 402 includes another mounting extension 407 as illustrated in FIGS. 16 and 17. The stop 400 is coupled to the rocker bottom 370 via the mounting extensions 406 and 407.

Similarly, stop 410 includes a body 412 and an extension 418. The body 412 includes a first side 414 on which a mounting extension 416 is located. The opposite side of the body 412 includes another mounting extension (not shown). The stop 410 is coupled to the rocker bottom 370 via its mounting extensions.

Figure 14:
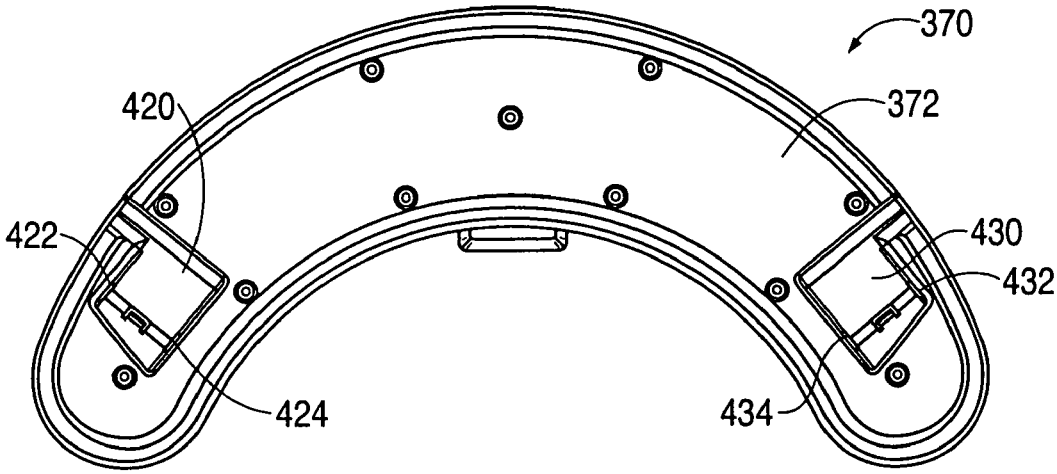
FIG. 14 illustrates a bottom view of the rocker bottom of the rocker of FIG. 13.
Figure 15:
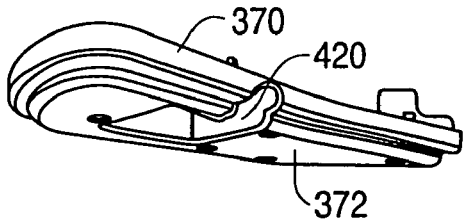
FIG. 15 illustrates a side view of the rocker bottom of FIG. 14.

Referring to FIGS. 14 and 15, the bottom surface 372 of the rocker bottom 370 is illustrated. The bottom surface 372 includes cavities 420 and 430. Each cavity is configured to receive one of the stops 400 and 410. Cavity 420 includes mount couplers 422 and 424 that are configured to receive the mounting extensions on stop 400. Similarly, cavity 430 includes mount couplers 432 and 434 that are configured to receive the mounting extensions on stop 410. The cavities facilitate the rocking of the rocker 305 by enabling the stops 400 and 410 to be disposed in recessed positions.

Turning to the operation of the rocker 305, the entertainment component 366 includes eight actuators or keys 388 as illustrated in FIG. 13. In alternative embodiments, any number of keys may be used. In one implementation, the actuators 388 may be associated with the musical notes C, D, E, F, G, A, B, and C. In one embodiment, the output generating system 201 includes eight LEDs located under the eight actuators 388.

In one embodiment, the rocker 305 can include music associated with multiple musical instruments stored in memory 206. For example, the stored music can be associated with instruments such as a tuba, piano, flute, harp and violin. In one embodiment, the musical outputs may be stored in the form of .MLD files.

In one embodiment, the processor 204 includes a model song counter that keeps track of the current song being played. For each instrument, the processor 204 loops through the songs stored for that instrument.

The output generating system 201 of the rocker 5 can be activated by either rocking the rocker 5 or by pressing or activating one of the input mechanisms. For example, the output generating system 201 is activated when any of the actuators 216 or other switches is activated.

In one exemplary mode of operation, referred to as a rock-and-play mode, the rocker 305 plays a song in its entirety in response to the closing of the motion switch 208. While the song is played, the lights 212 under the piano keys 388 are illuminated simultaneously with the music that is generated. In this mode, when the user hits one or more of the keys 388, the lights 212 stop flashing and each light 212 under a pressed key 388 is illuminated.

In another exemplary mode of operation, referred to as a build a song mode, a section of a song is played in response to the activation of one of the input mechanisms. In this mode of operation, a song is separated into particular section based on pause points. If an input is received within the last one to two beats of music prior to a pause point, the next section of the song is played. Otherwise the song is paused at the pause point and a timer is started for a particular amount of time. In one embodiment, the timer may be set for a ten second period, during which the output generating system 201 monitors for another input during that time. If no input is received, the rocker 305 enters a power down mode.

In another exemplary mode of operation, referred to as a free play mode, each piano key 388 triggers a note. Also, when the left switch of the motion switch 208 is closed, the notes of a musical scale are played in ascending order and the corresponding lights are illuminated. When the right switch of the motion switch 208 is closed, the notes of a musical scale are played in descending order and the corresponding lights are illuminated.

In the illustrated embodiment, the components of the rocker are molded plastic. In alternative embodiments, any material that can support an infant can be used.

In alternative embodiments, any type of outputs in any pattern can be generated by the output generating system.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. An activity rocker comprising:

a seat portion, said seat portion having an upper surface configured to support a user and a curved lower surface configured to engage a support surface;

an activity portion, said activity portion having an activity surface and a curved base surface configured to engage the support surface, said curved base surface of said activity portion being spaced apart from said curved lower surface of said seat portion;

a neck portion, said neck portion having a first end and a second end, said first end being coupled to said seat portion and said second end being coupled to said activity portion; and a plurality of actuators coupled to the activity portion, each of the actuators from the plurality of actuators configured to be selectively engaged by a user to produce an electronic output.

2. The activity rocker of claim 1, further comprising:

an activity center coupled to said activity surface, the plurality of actuators being coupled to the activity center.

3. The activity rocker of claim 2, wherein said activity center is releasably coupled to said activity surface.

4. The activity rocker of claim 2, wherein said activity center comprises an output generating system, said output generating system configured to generate at least one of an audible output and a visual output.

5. The activity rocker of claim 4, wherein said activity center comprises a mode selection switch, said mode selection switch being coupled to said output generating system and being configured to enable selection of a mode of operation of said output generating system.

6. The activity rocker of claim 1, wherein the plurality of actuators are configured as at least a portion of a keyboard.

7. The activity rocker of claim 1, wherein said neck portion includes a lower surface, a portion of said neck portion lower surface proximate to said neck portion first end being substantially aligned with said lower surface of said seat portion.

8. The activity rocker of claim 7, wherein a portion of said neck portion lower surface proximate to said neck portion second end is offset from said base surface of said activity portion.

9. The activity rocker of claim 1, wherein said seat portion is movable relative to said neck portion, said seat portion being disposable in a first position and in a second position on said neck portion, said seat portion being a first distance from said activity portion in said first position and a second distance from said activity portion in said second position, said first distance being different from said second distance.

10. The activity rocker of claim 1, wherein said neck portion has a curved base surface configured to engage the support surface.

11. The activity rocker of claim 1, wherein said output includes a plurality of discrete audible outputs.

12. The activity rocker of claim 1, wherein said plurality of actuators are depressible actuators.

13. The activity rocker of claim 1, wherein the output is a musical output.

14. The activity rocker of claim 1, wherein the output includes illumination of a light.

15. The activity rocker of claim 1, wherein the activity portion has a shape, the shape remains fixed when the output is produced.

16. An activity rocker comprising:

a seat portion, said seat portion having an upper surface configured to support a user and a substantially curved base surface configured to engage a support surface;

an activity portion, said activity portion having an activity surface and a substantially curved base surface configured to engage the support surface, said substantially curved base surface of said activity portion being spaced apart from said substantially curved base surface of said seat portion;

a neck portion, said neck portion having a first end, a second end, a lower surface, and a longitudinal axis, said first end being coupled to said seat portion, said second end being coupled to said activity portion, said longitudinal axis extending substantially horizontally between said seat portion and said activity portion, a first portion of said neck portion lower surface proximate to said neck portion first end being substantially aligned with said base surface of said seat portion, a second portion of said neck portion lower surface proximate to said neck portion second end being substantially offset from said base surface of said activity portion, each of said seat portion base surface and said activity portion base surface being configured for movement in a direction substantially perpendicular to said longitudinal axis; and an activity center coupled to said activity surface, said activity center including an output generating system, a mode selection switch, and a motion-activated switch, said activity center generating at least one of an audible output and a visual output in response to movement of said activity portion and activation of said motion-activated switch.

17. An activity rocker comprising:

a seat portion, said seat portion having an upper surface configured to support a user and a curved lower surface configured to engage a support surface;

an activity portion, said activity portion having an activity surface and a curved base surface configured to engage the support surface, said curved base surface of said activity portion being spaced apart from said curved lower surface of said seat portion;

at least one actuator coupled to said activity portion and configured to be selectively engaged by a user to produce an electronic output; and a neck portion having a curved base surface configured to engage the support surface, said neck portion having a first end and a second end, said first end being coupled to said seat portion and said second end being coupled to said activity portion.

18. An activity rocker comprising:

a seat portion, said seat portion having an upper surface configured to support a user and a curved lower surface configured to engage a support surface;

an activity portion, said activity portion having an activity surface and a curved base surface configured to engage the support surface, said curved base surface of said activity portion being spaced apart from said curved lower surface of said seat portion;

a neck portion, said neck portion having a first end and a second end, said first end being coupled to said seat portion and said second end being coupled to said activity portion; and a plurality of actuators coupled to the activity portion and configured as at least a portion of a keyboard, each of the actuators from the plurality of actuators configured to be selectively actuated to produce an output.

19. A method of generating an output from an activity rocker, the activity rocker having a seat portion with a user support surface and a curved base surface having a first portion and a second portion spaced apart from its first portion, an activity portion with an activity surface and a curved base surface having a first portion and a second portion spaced apart from its first portion, a connector with a first end coupled to the seat portion and a second end coupled to the activity portion, and an output generating system, the method comprising:

disposing the activity rocker on a support surface in a first position in which the first portion of the seat portion curved base surface contacts the support surface and the first portion of the activity portion curved base surface contacts the support surface; and moving the activity rocker to a second position in which the second portion of the seat portion curved base surface contacts the support surface and the second portion of the activity portion curved base surface contacts the support surface, each of the first portions of the seat portion and the activity portion being spaced apart from the support surface when the activity rocker is in its second position, said moving the activity rocker causing the output generating system to generate a first output; and selectively actuating an actuator from a plurality of actuators coupled to the activity portion, the actuating configured to cause the output generating system to generate a second output.

20. The method of claim 19, wherein the first output comprises at least one of an audible output and a visual output.

21. The method of claim 19, wherein the base surface of the seat portion is spaced apart from the base surface of the activity portion, and said moving the activity rocker includes rocking the activity rocker along the base surfaces.

22. An activity rocker comprising:

a seat, said seat having an upper surface and a lower surface, said upper surface being configured to support a user;

an activity component, said activity component having an activity surface and a base surface;

an entertainment device coupled to said activity component and having a plurality of depressible actuators coupled to an outer surface of the entertainment device and configured to be selectively actuated by a user; and a connector, said connector having a first end, a second end, and a longitudinal axis, said first end being coupled to said seat, said second end being coupled to said activity component, said longitudinal axis extending substantially horizontally between said seat and said activity component, and each of said lower surface and said base surface being configured to move along a direction substantially perpendicular to said longitudinal axis of said connector.

23. The activity rocker of claim 22, wherein said entertainment device comprises an output generating system, said output generating system being configured to generate at least one of an audible output and a visual output.

24. The activity rocker of claim 23, wherein said entertainment device includes a motion-activated switch, said output generating system being configured to generate said at least one of an audible output and a visual output in response to an activation of said switch.

25. The activity rocker of claim 22, wherein said lower surface is curved and said base surface is curved, said lower surface being spaced apart from said base surface.

26. The activity rocker of claim 22, wherein said lower surface is spaced apart from said base surface, said lower surface including a first radius of curvature, said base surface including a second radius of curvature, said first radius of curvature being substantially the same as said second radius of curvature.

27. The activity rocker of claim 22, wherein said lower surface is substantially coextensive with said upper surface.

28. The activity rocker of claim 27, wherein said base surface is substantially coextensive with said activity surface.

29. The activity rocker of claim 22, wherein said connector includes a lower surface, a portion of said connector lower surface proximate to said connector first end being substantially aligned with said seat lower surface, and a portion of said connector lower surface proximate to said connector second end being vertically offset from said base surface of said activity component.

30. The activity rocker of claim 22, wherein each of the plurality of depressible actuators is configured to produce an output.

31. An activity rocker comprising:

a seat portion, said seat portion having an upper surface configured to support a user and a curved lower surface configured to engage a support surface;

an activity portion, said activity portion having an activity surface and a curved base surface configured to engage the support surface, said curved base surface of said activity portion being spaced apart from said curved lower surface of said seat portion;

a neck portion, said neck portion having a first end and a second end, said first end being coupled to said seat portion and said second end being coupled to said activity portion; and a plurality of actuators coupled to the activity portion, each of the actuators from the plurality of actuators configured to be selectively engaged by a user to produce a plurality of discrete audible outputs.

* * * * *